US006180861B1

(12) United States Patent
Hashimoto

(10) Patent No.: US 6,180,861 B1
(45) Date of Patent: Jan. 30, 2001

(54) TONE GENERATION DEVICE AND METHOD, DISTRIBUTION MEDIUM, AND DATA RECORDING MEDIUM

(75) Inventor: Takeshi Hashimoto, Tokyo (JP)

(73) Assignee: Sony Computer Entertainment Inc., Tokyo (JP)

( * ) Notice: Under 35 U.S.C. 154(b), the term of this patent shall be extended for 0 days.

(21) Appl. No.: 09/311,248

(22) Filed: May 13, 1999

(30) Foreign Application Priority Data

May 14, 1998 (JP) ..... 10-131930

(51) Int. Cl.[7] ..... G10H 7/00
(52) U.S. Cl. ..... 84/601; 84/605; 704/500
(58) Field of Search ..... 84/601–605; 704/500–504

(56) References Cited

U.S. PATENT DOCUMENTS 5,416,264 * 5/1995 Toda et al. ..... 84/603
5,442,127 * 8/1995 Wachi et al. ..... 84/603
5,530,750 * 6/1996 Akagiri .

FOREIGN PATENT DOCUMENTS 6-167978 6/1994 (JP) .

* cited by examiner

*Primary Examiner*—Jeffrey Donels
(74) *Attorney, Agent, or Firm*—Helfgott & Karas, P.C.

(57) ABSTRACT

To eliminate the delay time from when a request is made for playing a prescribed tone until it is actually played. Tone data in which the beginning part of the data that generates one effect sound is uncompressed data and the remaining part is compressed data, is stored in a compressed data unit. An arithmetic processing unit reads the data stored in the compressed data unit and decides whether this data is compressed data. If the data is uncompressed data, the data is transferred via multiplexer 9 to speaker 50 and is played. While the uncompressed data is being played, the remaining data is transferred to an expansion unit, where expansion processing is performed on it. If the expansion-processed data requires later-stage processing, it is stored in a post-expansion data unit, and if no such processing is required, it is transferred via a multiplexer to a speaker and is played.

7 Claims, 8 Drawing Sheets

TONE GENERATION DEVICE AND METHOD, DISTRIBUTION MEDIUM, AND DATA RECORDING MEDIUM

FIELD OF THE INVENTION

This invention relates to a tone generation device and method, distribution medium, and data recording medium. More specifically, the invention relates to a tone generation device and method, distribution medium, and data recording medium wherein a compression method is used in which little time is required to expand the beginning part of the data for generating one tone, or no compression is done, and for the other part, compressed tone data is used using a high-compression method, and while the beginning part of the data is being expansion-processed and played, the other part is being processed, thereby making the delay time from when the request is made to play a prescribed tone until it is played unnoticeable to the user.

BACKGROUND OF THE INVENTION

In an electronic musical instrument or game machine, user operation occurs randomly, so the tones that are to be played cannot be anticipated and it has been impossible to generate tones by predicting user operations for sound-expression requests. One requirement for an electronic musical instrument or game machine is that when a request is made for playing a prescribed tone, it must be played immediately. In order to handle such unpredictable requests for immediate expression, the tone data used in electronic musical instruments and game machines has either not been compressed or has been compressed using a compression method whose processing time upon expansion is short, such as, for example, adaptive differential pulse-coded modulation (ADPCM).

In a minidisk (MD), ATRAC (adaptive transform acoustic coding) and ATRAC 2 have been developed as high-efficiency encoding audio compression techniques. These techniques provide high sound quality, predict the coming data (not controlled by user operation) in order to pre-read the data, and are making it possible to realize music playback machines that can generate tones.

ADPCM can compress data to about ¼, and ATRAC 2 can compress data to about 1/10 to 1/20. Furthermore, the sound obtained by expanding data compressed by ATRAC 2 is closer to the original sound (the pre-compressed sound) than is the sound obtained by expanding data compressed by ADPCM.

However, ATRAC 2 imposes a heavier (about 20-fold) processing burden for compression and expansion than does ADPCM, and for this reason it has been considered unsuitable for electronic musical instruments and game machine, in which user requests for sound generation must produce the desired expression immediately.

Also, in an electronic musical instrument or game machine, requests for the expression of multiple tones are sometimes made simultaneously, which leads to the problem that not all the tones can be generated (expressed) immediately if a compression method requiring heavy processing, such as ATRAC 2, is used.

SUMMARY OF THE INVENTION

The present invention eliminates the delay time between a sound expression request and when the sound is expressed and makes it possible to use a high-efficiency encoding sound compression method. This is done by tone data that is compressed using different compression methods for the beginning part and the other part of the data for generating one tone, and by storing part of the expansion-processed data.

The tone generation device of the present invention has a reading means that reads tone data consisting of first data that either is not compressed or is compressed by a first compression method having a short time required for expansion processing and second data that is compressed by a second compression method having a time required for expansion processing which is longer than for the first compression method; a first output means that expands said first data as necessary among the data read by the reading means and outputs it; and a second output means that expands and outputs said second data.

The tone generation method also includes a reading step which reads tone data consisting of first data that either is not compressed or is compressed by a first compression method having a short time required for expansion processing and second data that is compressed by a second compression method having a time required for expansion processing which is longer than for the first compression method; a first output step that as necessary expands the first data among the data read by the reading means and outputs it; and a second output step that expands and outputs the second data.

The distribution medium provides a computer-readable program that executes processing that includes a reading step which reads tone data consisting of first data that either is not compressed or is compressed by a first compression method having a short time required for expansion processing and second data that is compressed by a second compression method having a time required for expansion processing which is longer than for the first compression method; a first output step that as necessary expands the first data among the data read by the reading means and outputs it; and a second output step that expands and outputs the second data.

Tone data is recorded on the data recording medium from first data that either is not compressed or is compressed by a first compression method having a short time required for expansion processing and second data that is compressed by a second compression method having a time required for expansion processing which is longer than for the first compression method.

The tone generation device of the present invention has a first memory means that stores compressed tone data; an expansion means that expands the compressed tone data read by the first memory means; a decision means that decides whether to store the tone data expanded by the expansion means; a second memory means that stores the tone data expanded by the expansion means in accordance with the decision result of the decision means; and an output means that selects and outputs the output of the second memory means or the output of the expansion means.

The tone generation method includes a first memory step that stores compressed tone data; an expansion step that expands the compressed tone data read in the first memory step; a decision step that decides whether to store the tone data expanded in the expansion step; a second memory step that stores the tone data expanded in the expansion step in accordance with the decision result of the decision step; and an output step that selects and outputs the output of the second memory step or the output of the expansion step.

The distribution medium provides a computer-readable program that executes processing that includes a first memory step that stores compressed tone data; an expansion step that expands the compressed tone data read in the first memory step; a decision step that decides whether to store the tone data expanded in the expansion step; a second memory step that stores the tone data expanded in the expansion step in accordance with the decision result of the decision step; and an output step that selects and outputs the output of the second memory step or the output of the expansion step.

The tone data that is read consists of first data that either is not compressed or is compressed by a first compression method having a short time required for expansion processing and second data that is compressed by a second compression method having a time required for expansion processing which is longer than for the first compression method. Among the data that is read, the first data is expanded and output as necessary, and the second data is expanded and output.

Tone data is recorded in the data recording medium consisting of first data that either is not compressed or is compressed by a first compression method having a short time required for expansion processing and second data that is compressed by a second compression method having a time required for expansion processing which is longer than for the first compression method.

In the tone generation device the tone generation method and the distribution medium tone data read from a memory in which compressed tone data is stored is expanded, it is decided whether to store the expanded tone data, the expanded tone data is recorded in accordance with the decision result, and the stored data or expanded data is selected and output.

BRIEF DESCRIPION OF THE DRAWINGS

DETAILED DESCRIPTION OF THE PREFERRED EMBODIMENT

The following embodiment is one example of the present invention, it being understood that the invention is not limited thereto.

The tone generation device has a reading means (for example, step S1 in FIG. 6) that reads tone data consisting of first data that either is not compressed or is compressed by a first compression method having a short time required for expansion processing and second data that is compressed by a second compression method having a time required for expansion processing which is longer than for the first compression method; a first output means (for example, step S6 in FIG. 6) that as necessary, expands said first data among the data read by the reading means and outputs it; and a second output means (for example, step S7 in FIG. 6) that expands and outputs the second data.

The tone generation device has a first memory means (for example, compressed data unit 5*b* in FIG. 7) that stores compressed tone data; an expansion means (for example, expansion unit 52 in FIG. 7)that expands the compressed tone data read by the first memory means; a decision means (for example, step S13 in FIG. 9) that decides whether to store the tone data expanded by the expansion means; a second memory means (for example, memory unit 53 in FIG. 7 and step S15 in FIG. 9) that stores the tone data expanded by the expansion means in accordance with the decision result of the decision means; and an output means (for example, steps S16 and S20 in FIG. 9) that selects and outputs the output of the second memory means or the output of the expansion means.

Figure 1:
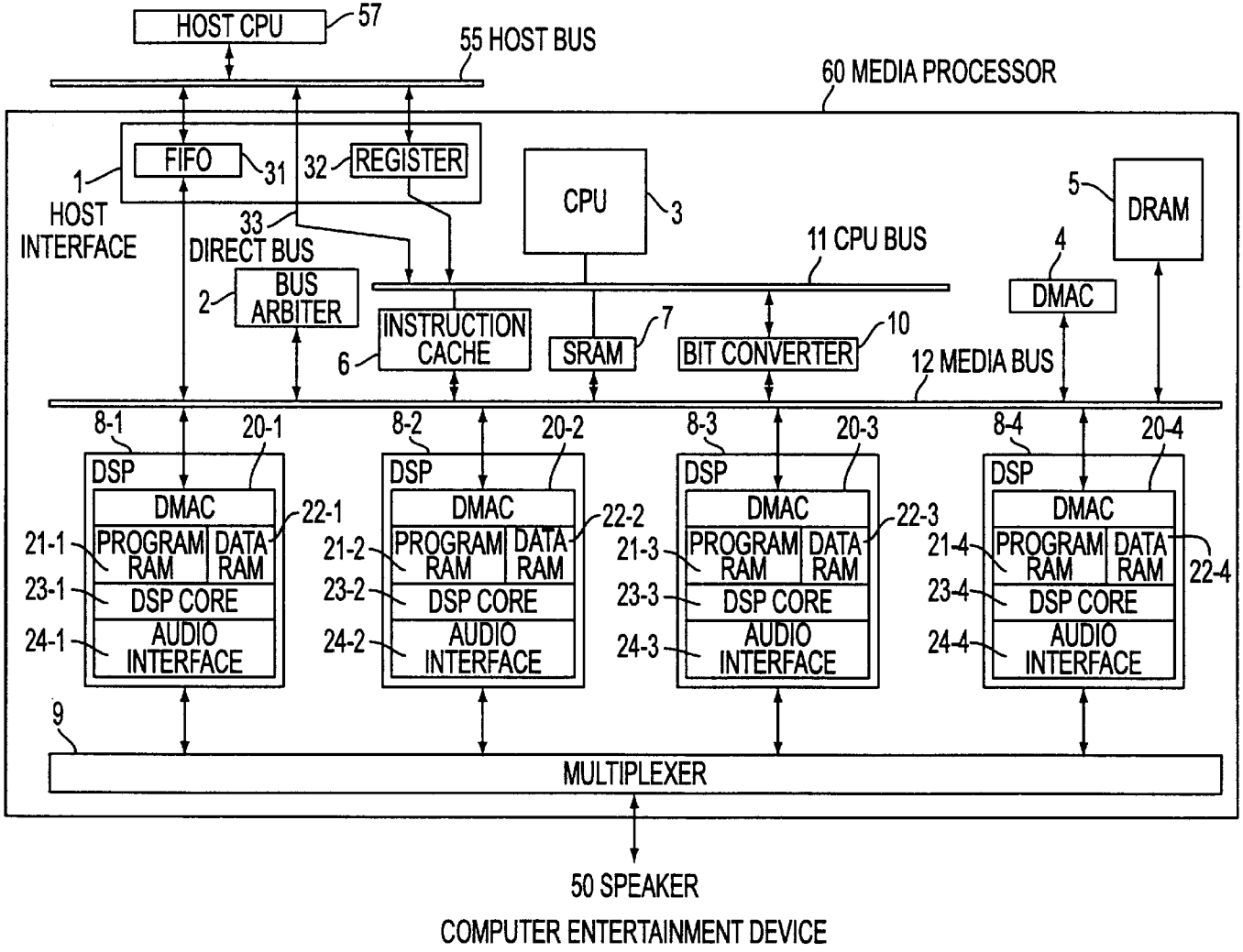
FIG. 1 is a block diagram showing the composition of an embodiment of a computer entertainment device to which the tone generation device of the invention is applied.

FIG. 1 is a block diagram of an example of the configuration in the case where the tone generation device of this invention is applied to a computer entertainment device. In this computer entertainment device, media processor 60, which consists of one LSI chip, is connected via host bus 55 to host CPU 57. Host interface 1 of media processor 60 consists of FIFO 31, register 32, and direct bus 33, each of which is connected to host bus 55.

Connected to CPU bus 11 of media processor 60 are register 32, direct bus 33, CPU 3, instruction cache 6, SRAM 7, and bit converter 10. Connected to main bus 12 of media processor 60 are host interface 1 (specifically, FIFO 31), bus arbiter 2, instruction cache 6, SRAM 7, bit converter 10, DMAC (direct memory access controller) 4, DRAM 5, and digital signal processors (DSPs) 8-1 through 8-4.

Host CPU 57 executes various processing according to a program stored in a memory not pictured. For example, host CPU 57 may store programs and data from a recording medium such as a CD-ROM (compact disk, read-only memory) not shown in FIG. 1 or conversely acquire programs and data stored in DRAM 5. In doing so, host CPU 57 makes a request to DMAC 4 and causes execution of a DMA transfer between FIFO 31 and DRAM 5. Also, host CPU 57 may directly access DRAM 5 and other devices via direct bus 33.

Bus arbiter 2 arbitrates the use rights to main bus 12. For example, when there is a request for data transfer from host CPU 57 to DMAC 4, bus arbiter 2 gives the bus right to DMAC 4 so that data transfer by DMA (direct memory access) can be made from host CPU 57 to DRAM 5.

FIFO 31 temporarily stores the data that is output from host CPU 57 and outputs it to DRAM 5 via main bus 12, and temporarily stores the data that is transferred from DRAM 5 and outputs it to host CPU 57. Register 32 is a register that is used when handshaking is done between host CPU 57 and CPU 3; it stores data that expresses the status of processing and commands.

CPU 3 accesses instruction cache 6, loads and executes the program stored there, and as necessary accesses SRAM 7 and is supplied the prescribed data. And if there is no data that is needed for SRAM 7, CPU 3 makes a request to DMAC 4 and causes execution of a transfer of data by DMA from DRAM 5 to SRAM 7. And if there is no program that is needed for instruction cache 6, CPU 3 makes a request to DMAC 4 and causes execution of a program transfer by DMA from DRAM 5 to instruction cache 6.

SRAM 7 can access any address and read and write data simultaneously from both CPU 3 and DMAC 4; for example, it is a dual-port SRAM and is provided as a data cache, and among the data stored in DRAM 5, it stores data that is frequently accessed from CPU 3. SRAM 7 may have a two-bank composition, one being connected to CPU bus 11 and the other to main bus 12.

Instruction cache 6 is a cache memory where any address can be accessed and data can be read and written;

of the programs stored in DRAM 5, it stores programs that are frequently accessed from CPU 3.

Bit converter 10 converts the bit width of the data input via CPU bus 11 to the bit width (for example, 128 bits) corresponding to main bus 12 and outputs it, and converts the bit width (for example, 32 bits) of the data input via main bus 12 to the bit width corresponding to CPU bus 11 and outputs it.

DSP 8-1 consists of program RAM 21-1, which stores programs used when DSP core 23-1 performs various operations, data RAM 22-1, which stores data, DMAC 20-1, which manages the transfer of programs and data stored in these, and audio interface 24-1, which outputs to multiplexer 9 the audio data generated by DSP core 23-1.

Although the description is omitted, DSPs 8-2 through 8-4 likewise each have the same internal structure as DSP 8-1. Multiplexer 9 selects the audio data output from audio interfaces 24-1 through 24-4 and outputs it to speaker 50.

Figure 2:
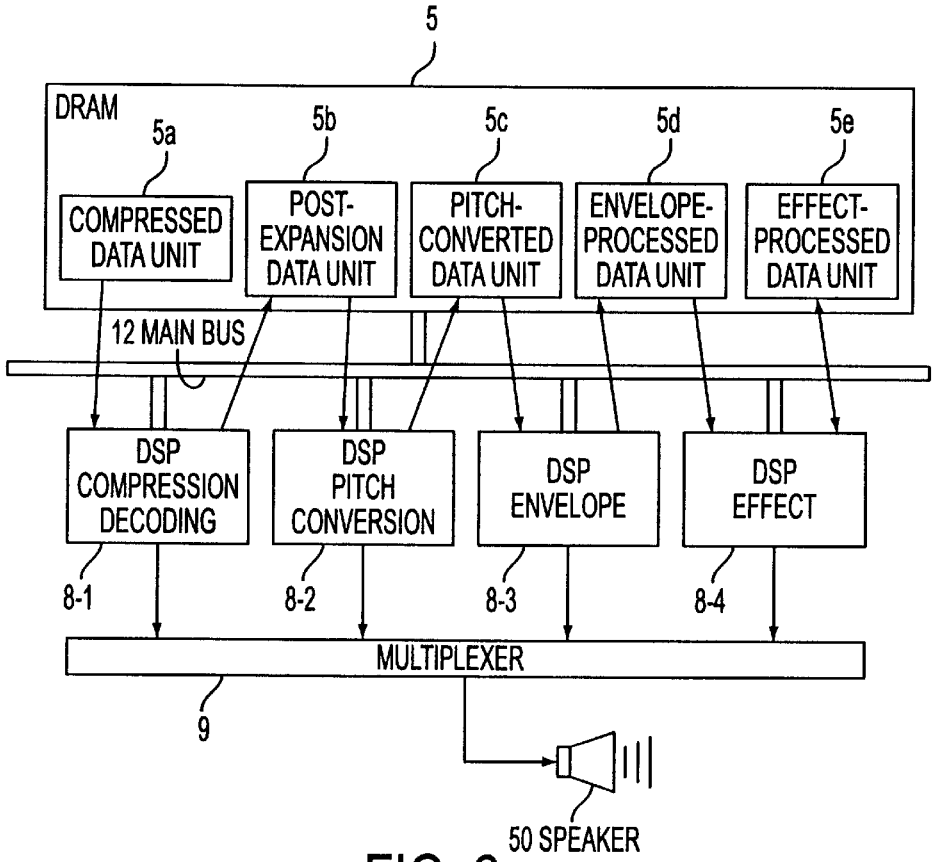
FIG. 2 is a block diagram showing the configuration of a tone generation device.

FIG. 2 excerpts from FIG. 1 the part that concerns the tone generation device; it shows the processing done by each part as well as the flow of data. Compressed data of the tones that host CPU 57 (FIG. 1) reads from a CD-ROM or other recording medium not shown is stored in compressed data unit 5*a* of DRAM 5. The stored data is transferred to DSP 8-1 via bus 12. DSP 8-1 decodes (expands) the compressed data that is transferred. Then this expanded data is either transferred to and stored in post-expansion data unit 5*b* of DRAM 5 or, as necessary, is played back by speaker 50 via multiplexer 9.

The data stored in post-expansion data unit 5*b* is read by DSP 8-2, and pitch conversion is performed on it. Pitch conversion means, when generating a tone, to generate another (higher) musical interval by, for example, taking a lower tone as the fundamental tone and changing the frequency of this fundamental tone. For example, if fast-forwarding is done in a cassette tape recorder (if more data than usual is played back per unit of time), the sound is heard at a higher pitch. It is clear from this fact that in order to make a sound higher it is necessary to change the reading speed (pitch), read the next data, and increase the amount of data. Conversely, if a tone lower than the fundamental tone is to be expressed, it suffices to have data that is less than in the case when the tone is to be expressed at the fundamental tone.

The data that is pitch-converted by DSP 8-2 is either transferred to and stored in pitch-converted data unit 5*c* of DRAM 5 or, as necessary, is played back by speaker 50 via multiplexer 9.

Figure 3A:
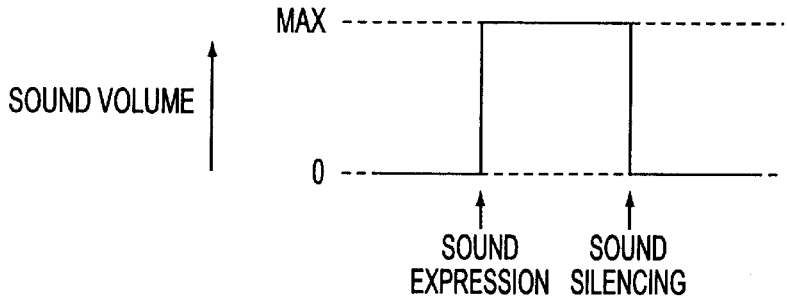
FIG. 3 is a diagram explaining envelope processing.
Figure 3B:
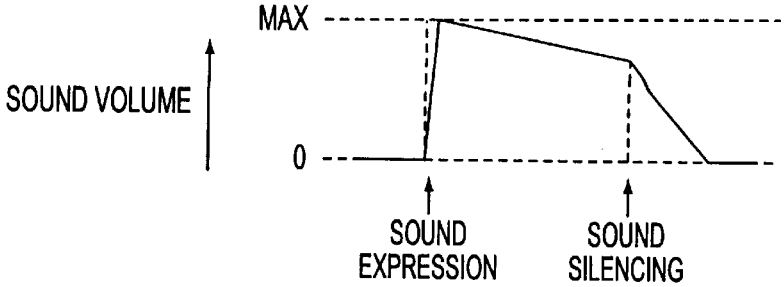

Data stored in pitch-converted data unit 5*c* is read by DSP 8-3, and envelope processing is performed. This envelope processing is done in order to change (set) the timbre. In order to change the timbre of a sound of the same musical interval, it suffices to vary the sound volume of the sound expression and sound silencing (attack and falloff). For example, the timbre of an organ can be reproduced if, as shown in FIG. 3(A), the sound volume reaches its maximum value immediately after the sound is initiated, a fixed sound volume continues, then the sound volume reaches its minimum value (disappears) immediately after the sound is silenced, and the timbre of a piano can be reproduced if, as shown in FIG. 3(B), the sound volume reaches its maximum volume gradually after the sound is initiated, it is gradually attenuated, then, after the sound is silenced, the sound volume grows gradually smaller.

In DSP 8-3, the envelope-processed data is either transferred to and stored in envelope-processed data unit 5*d* of DRAM 5 or, as necessary, is reproduced by speaker 50 via multiplexer 9.

The data stored in enveloped-processed data unit 5*d* is read by DSP 8-4, and effect processing is done on it. Effect processing is processing that adds a change to the sound, such as an echo or distortion. The effect-processed data is transferred to and stored in effect-processed data unit 5*e* of DRAM 5. When the effect processing is completed after being done only once, the processed data is expressed by speaker 50 via multiplexer 9.

If effect processing is done twice or more, first, the first-time effect processing is done by DSP 8-4, and this data is temporarily transferred to and stored in effect-processed data unit 5*e*. Then, if second-time effect processing is done, DSP 8-4 reads the data that is stored in effect-processed data unit 5*e* and performs the second-time effect processing on it. Thus effect processing is done multiple times by exchanging data between DSP 8-4 and effect-processed data unit 5*e*.

Figure 4:
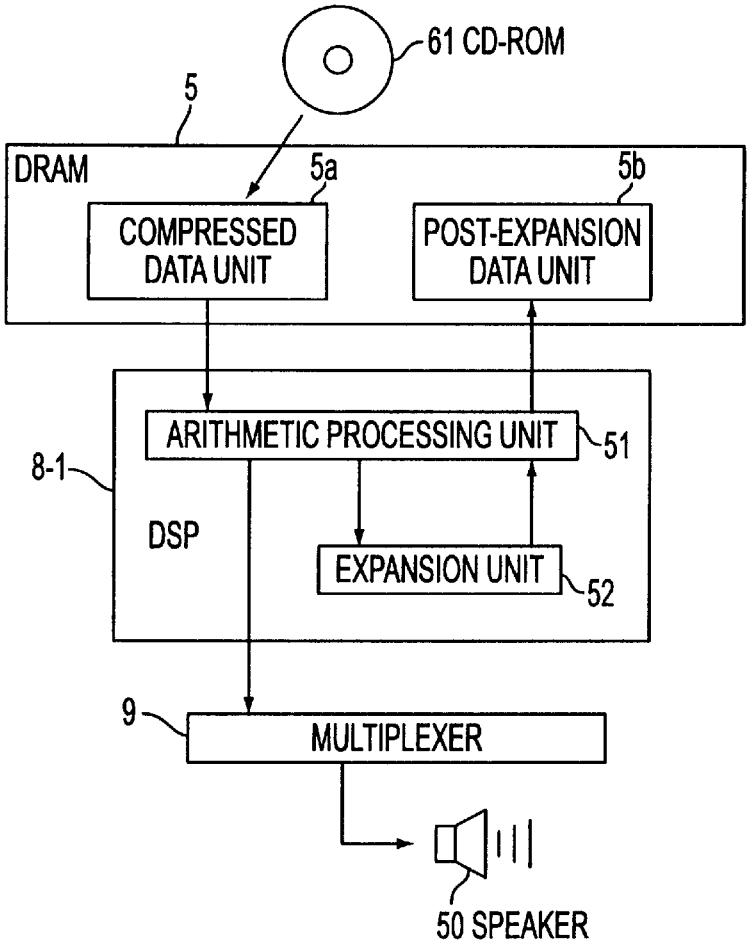
FIG. 4 is a diagram explaining the flow of data relating to expansion processing.

FIG. 4 is a block diagram in which the part related to expansion processing is excerpted from FIG. 2. DSP 8-1 functionally includes within it arithmetic processing unit 51 and expansion unit 52. Arithmetic processing unit 51 and expansion unit 52 correspond to DSP core 23-1 and digital audio unit 24-1 in FIG. 1.

Figure 5:
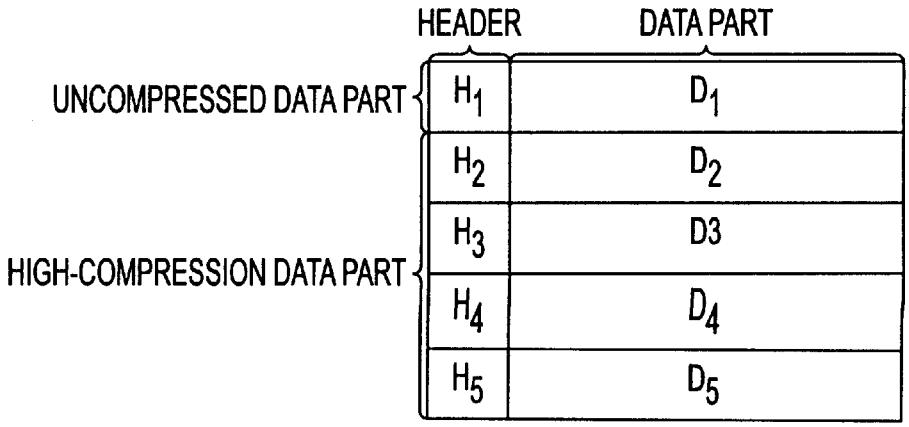
FIG. 5 is a diagram explaining the data structures used in the expansion processing of FIG. 4.

Data read by host CPU 57 from CD-ROM 61 and transferred to DRAM 5 is stored in compressed data unit 5*a*. Data stored in compressed data unit 5*a* is read by arithmetic processing unit 51 of DSP 8-1. Arithmetic processing unit 51 transfers the read data to expansion unit 52 or multiplexer 9. Data transferred to expansion unit 52 is expansion-processed and returned to arithmetic processing unit 51. And arithmetic processing unit 51 as necessary transfers the returned data to, and stores it in, post-expansion data unit 5*b* of DRAM 5. Also, data transferred to multiplexer 9 is played by speaker 50. FIG. 5 is of the tone data recorded on CD-ROM 61 and shows the structure of the data recorded in compressed data unit 5*a*. Data of the structure shown in FIG. 5 is, for example, data that produces a single effect sound (hereafter referred to as a one effect sound). In this case, one effect sound consists of a one-block uncompressed data part and a four-block high-compression data part. The uncompressed data part consists of header part H1 and data part D1. Similarly, each block of the high-compression data part consists of header part H2 through H5 and data part D2 through D5.

For example, if the one effect sound is the bang sound "dokaan," the "do" part is made to be the data (uncompressed data) of data part D1, and the "kaan" part is made to be the data (high-compression data) of data parts D2 through D5. Therefore the total number of blocks of tone data constituting one effect sound varies depending on the temporal length of the effect sound and the quantity of data in the uncompressed data and the high-compression data. The number of blocks in the uncompressed data part and the high-compression data part is not limited to one block and four blocks, respectively.

Written in the headers H1 through H5 are the size of the corresponding data parts D1 through D5, whether the data part is compressed or uncompressed, and if compressed, the compression method. The size of data parts D1 through D5 need not be written in if each block is of the same uniform size. For example, if ATRAC (adaptive transform acoustic coding) 2 is used as a high-compression method, then normally the size of the data part of one block is 2048 Ts (1 Ts=1/44,100 second, so this is the data corresponding to 2048/44,100 second), and by adopting this size as the uniform size of the data part of the uncompressed data part and the data part of the high-compression data part, there is no longer any need to write in the size of the data parts D1 through D5 that correspond to headers H1 through H5.

Figure 6:
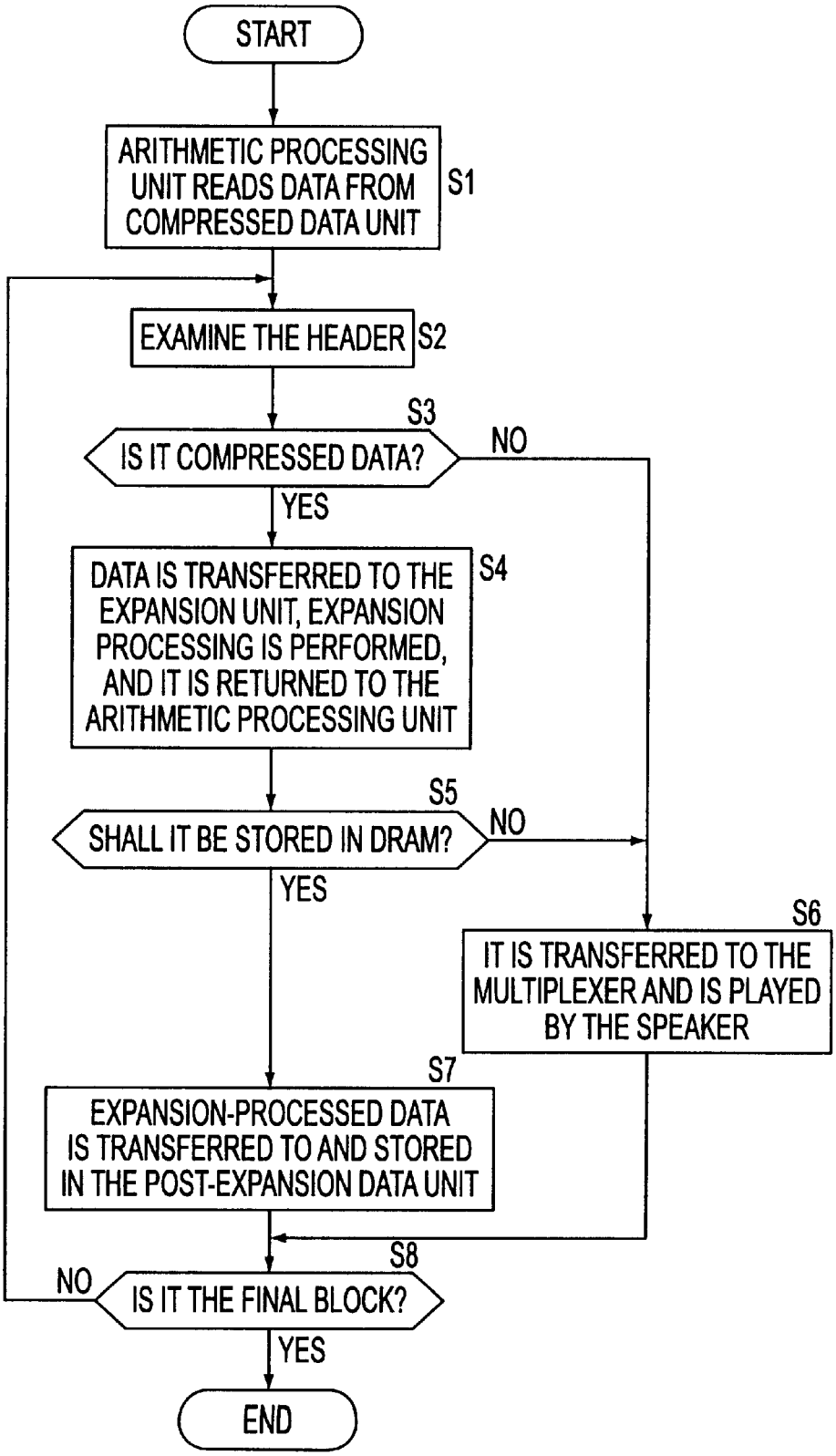
FIG. 6 is a flowchart explaining the expansion processing of FIG. 4.

Next, referring to the flowchart in FIG. 6, we describe the operation of the tone generation device shown in FIG. 4, in particular during expansion processing. First, it is assumed that multiple tone data read previously from CD-ROM 61 has been stored in compressed data unit 5*a* of DRAM 5.

In step S1, arithmetic processing unit 51 reads the tone data for one effect sound (in FIG. 5, the five blocks) from compressed data unit 5*a*. In step S2, arithmetic processing unit 51 reads the data that appears in the header of each block of the read tone data. First, the data in header H1 is read. Using the read data, in step S3 arithmetic processing unit 51 decides whether the data of data part D1 has been compressed.

In this case, if, depending on the information in header H1, the data part D1 is judged to be uncompressed data, it proceeds to step S6. In step S6, the data of data part D1 is transferred to multiplexer 9, and by multiplexer 9 it is further transferred to speaker 50. Then it is played by speaker 50. When the processing of step S6 is completed, it proceeds to step S8, and arithmetic processing unit 51 decides whether the processed data is the final block. In the present case, it is not the final block, so it returns to step S2.

In step S2, arithmetic processing unit 51 reads the data that has been written in header H2. And in step S3 it decides, based on the read data, whether it is compressed data. In the present case, it is written in header H2 that data part D2 is compressed data, so it is decided that data part D2 is compressed data, and it proceeds to step S4. In step S4, arithmetic processing unit 51 transfers the data of data part D2 to expansion unit 52, and expansion processing is performed. Then the expansion-processed data is returned again to arithmetic processing unit 51.

In step S5, arithmetic processing unit 51 decides whether the returned expansion-processed data shall be stored in DRAM 5. In other words, it decides whether it is data that does not require any subsequent processing (processing by DSPs 8-2 through 8-4). If, as a result, it is decided that there is no need to store it in DRAM 5, it proceeds to step S6. The processing in step S6 has already been described, so we dispense with an explanation of it.

If in step S5 it is decided to store the data in DRAM 5, it proceeds to step S7. In step S7, arithmetic processing unit 51 transfers the expansion-processed data to, and stores it in, post-expansion data unit 5*b* of DRAM 5.

Processing for sound generation is performed successively by the subsequent DSPs 8-2 through 8-4 on the data stored in post-expansion data unit 5*b*. Thus, first, uncompressed data part D1 is immediately played by the speaker, and while this is taking place, high-compression data parts D2 through D5 are processed, and in this way no delay occurs from when a request is made to play a prescribed tone until it is played, and although the compression ratio, such as for ATRAC 2, is high for data parts D2 through D5, it is possible to use a compression method that takes time for the expansion processing.

When the processing in step S7 is completed, it proceeds to step S8, and it is decided whether the processed data is the final block. If it is decided that it is not the final block, it returns to step S2, and the processing beginning here is repeated. On the other hand, if in step S8 it is decided that it is the final block, in the present case, if it is decided that the processed data is the data of data part D5, then the processing of this flowchart is terminated.

In the foregoing explanation, uncompressed data and high-compression data were used, but low-compression data may be used instead of uncompressed data. Here the descriptions of uncompressed, low-compression, and high-compression are used in the sense that uncompressed or low-compression refer to compression in which little time is required for the expansion processing, and conversely, high-compression refers to compression in which a long time is required for the expansion processing. Thus, compression in which little time is required for the expansion processing, even though it may be high compression, is referred to in this specification as uncompressed or low-compression.

Figure 7:
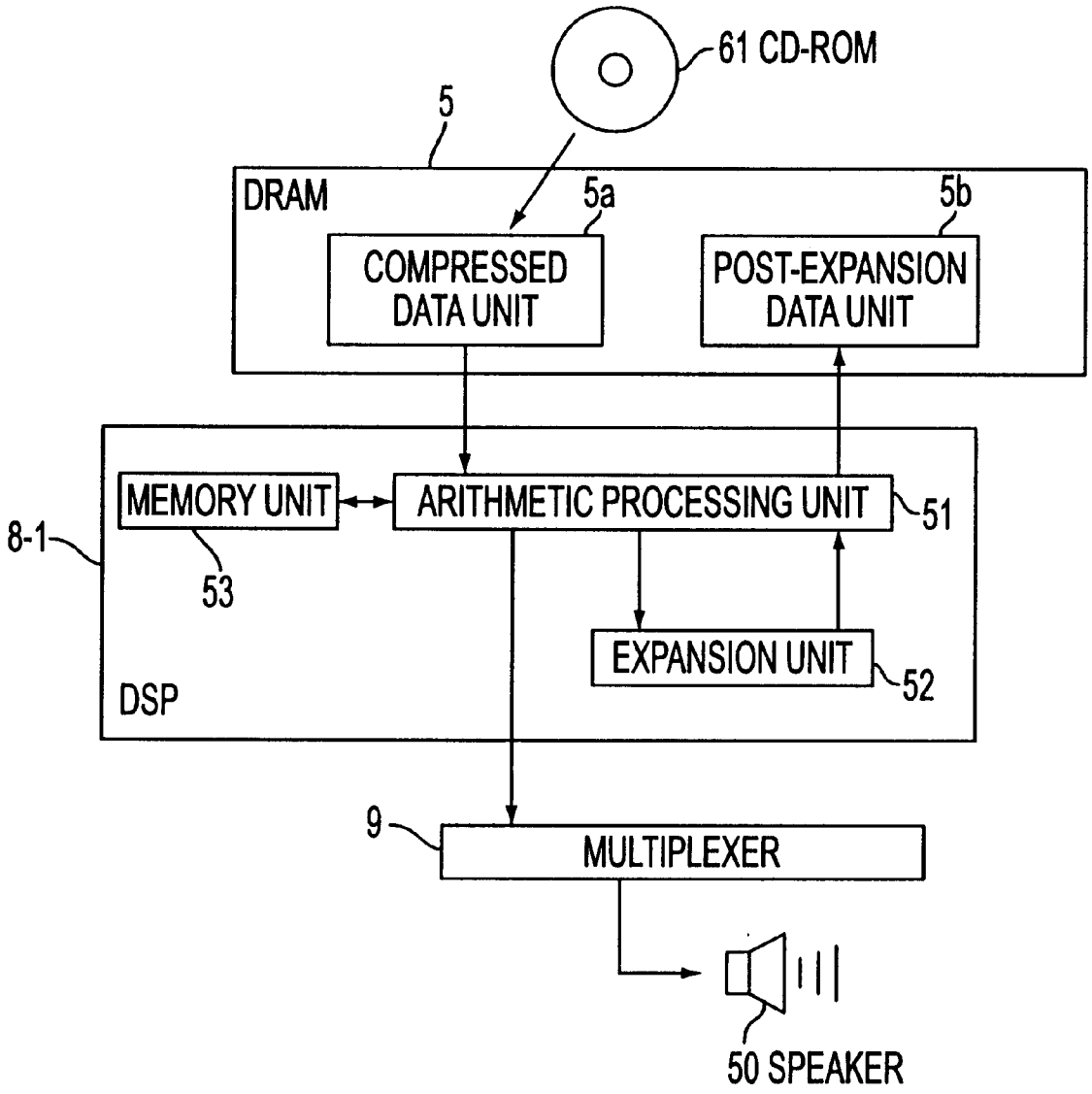
FIG. 7 is a diagram explaining the flow of data relating to other expansion processing.

Memory unit 53 inside DSP 8-1 as shown in FIG. 7 makes it possible, even with data that employs high compression, to do the expansion so that no delay arises from the request to play a sound until it is played. This memory unit 53 corresponds to data RAM 22-1 in FIG. 1.

Figure 8A:
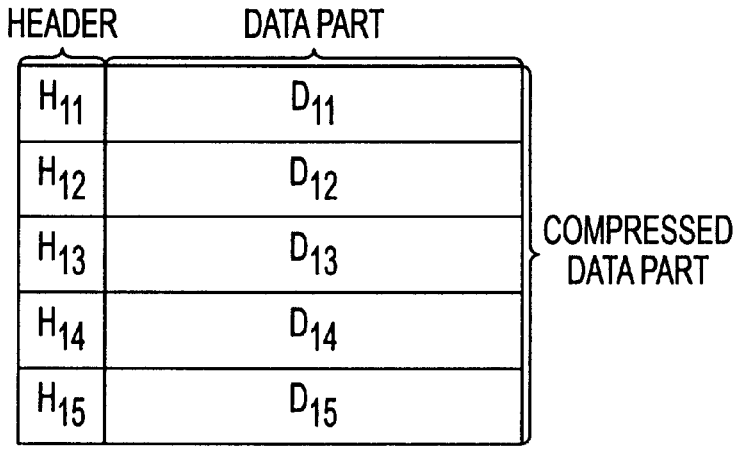
FIG. 8 is a diagram explaining the data structures used in the expansion processing of FIG. 7.

The tone generation device having DSP 8-1 shown in FIG. 7 handles data that has the data structure shown in FIG. 8(A). That is, an entire one effect sound (data parts D11 through D15) is compressed using the same compression method, and headers H11 through H15 are attached to each data part D11 through D15. Of the expanded data d11 through d15 (FIG. 8(B)) made by expanding the data shown in FIG. 8(A), the block of expanded data d11 is stored in memory unit 53 of DSP 8-1 (the memory data unit), and the rest of the expanded data d12 through d15 is released (the released data part) when it is transferred to a subsequent stage (DSPs 8-2 through 8-4, or multiplexer 9).

Figure 8B:
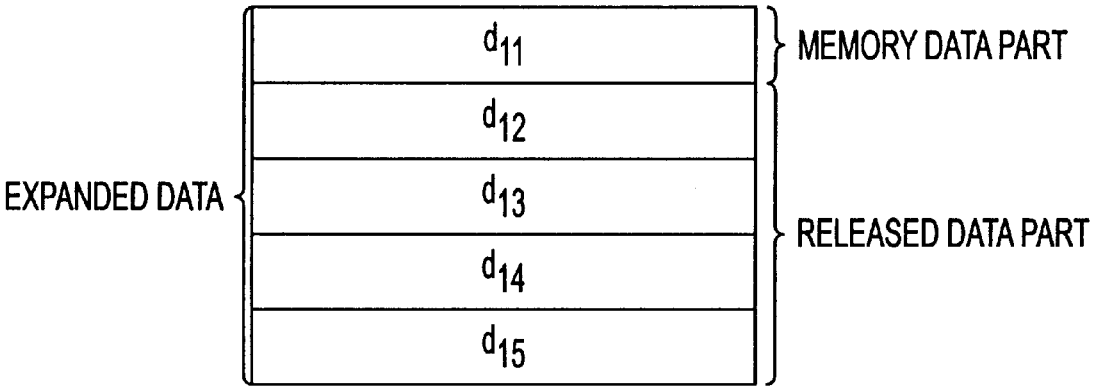

In FIG. 8(A), the compressed data part consists of 5 blocks, but as explained in FIG. 5, the total number of blocks varies with the quantity of tone data that constitutes one effect sound. FIG. 8(B) shows one block as memory data, but one may also have one or more blocks as memory data. The quantity of data stored in this memory unit 53 is written into each of the headers H11 through H15 shown in FIG. 8(A). What is written into these headers H11 through H15 includes, besides the quantity of data to be stored in memory unit 53, the data size of data parts D11 through D15, the compression method, etc.

Figure 9:
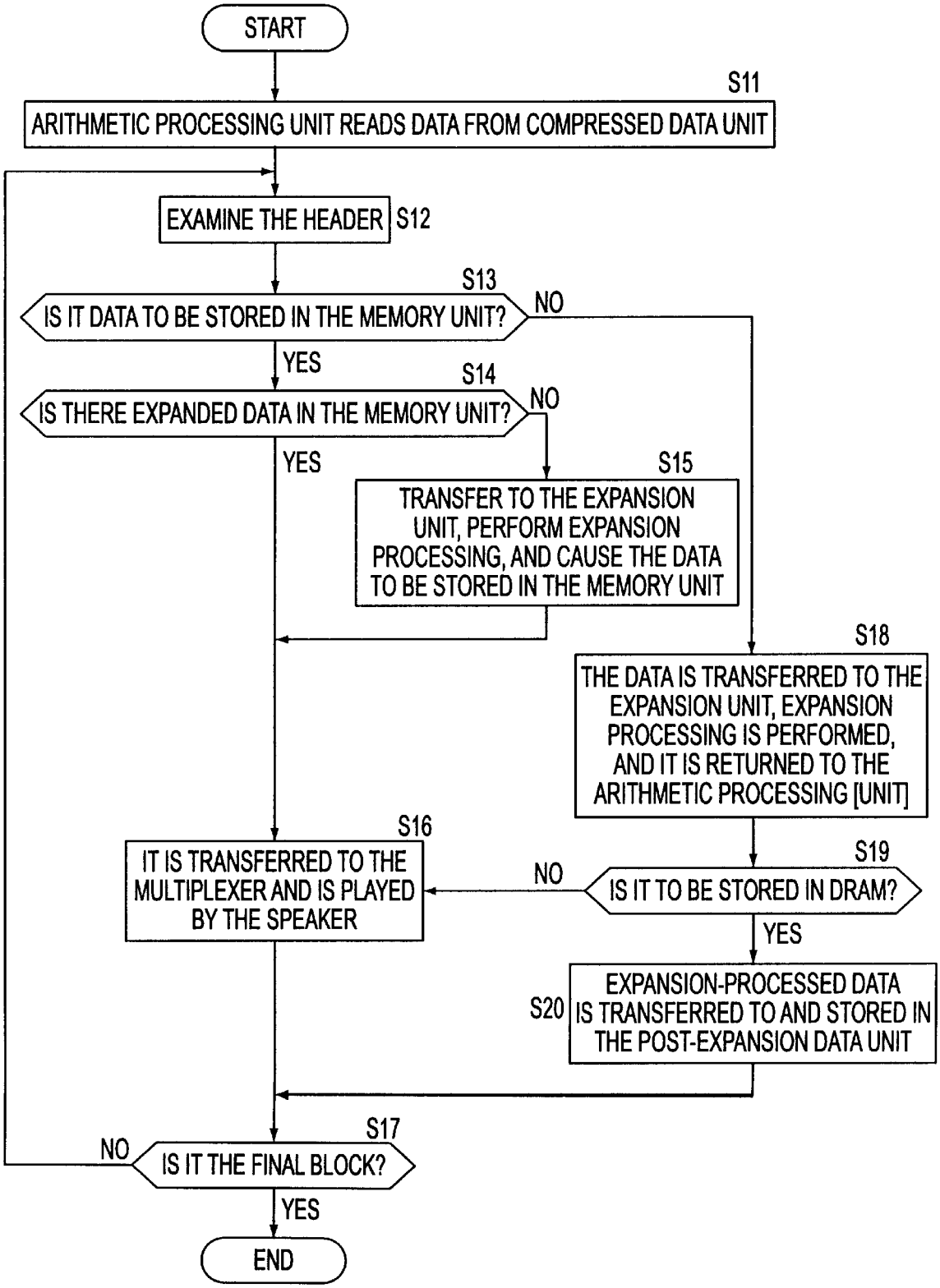
FIG. 9 is a flowchart explaining the expansion processing of FIG. 7.

The flowchart of FIG. 9 shows the operation of the part of the tone generation device shown in FIG. 7 that concerns expansion processing. First, in step S11, arithmetic processing unit 51 reads from compressed data unit 5*a* data that has the data structure shown in FIG. 8(A).

In step S12, arithmetic processing unit 51 examines, one after another, the headers H11 through H15 of the read data. Looking first at header H11, it reads the data that is written in it. In step S13, based on the data in header H11 it is decided whether the data of data part D11 is data that is to be stored in memory unit 53. In the present case, it is written in header H11 that the data of data part D11 is data that is to be stored in memory unit 53, so in step S13 it is decided that the data of data part D11 is data that is to be stored in memory unit 53, and it proceeds to step S14.

With regard to the data which, it is decided in step S13, is data that is to be stored in memory unit 53, in some cases expanded data has already been stored in memory unit 53 in the processing of step S15, which is referred to below. Therefore in step S14 it is decided whether, in the present case, the expanded data d11 of data part D11 has been stored in memory unit 53. This decision is made using a unique number assigned to data part D11.

That is, a number unique to each of the data parts D11 through D15 is written into each header H11 through H15. And in step S15, which is referred to below, this number unique to the data part is also stored when the expanded data is stored in memory unit 53. Therefore the processing done in step S14 is processing in which it is decided whether memory unit 53 contains data having the same number as the number unique to the data part written in the header of the data part read by arithmetic processing unit 51.

If, as a result, it is decided that expanded data d11 has not been stored in memory unit 53, it proceeds to step S15. In step S15, arithmetic processing unit 51 transfers the data of data part D11 to expansion unit 52 and causes expansion processing to be performed on it. The expansion-processed expanded data d11 is returned to arithmetic processing unit 51. Then arithmetic processing unit 51 stores the returned expanded data d11 in memory unit 53. Also, the expanded data d11 that is returned to arithmetic processing unit 51 is transferred to multiplexer 9 in step S16. The expanded data d11 that is transferred to multiplexer 9 is transferred to and played on speaker 50.

If in step S14 it is decided that expanded data d11 has already been stored in memory unit 53, this data is read. And in step S16 the read expanded data d11 is transferred to speaker 50 via multiplexer 9 and is played.

When the processing in step S16 comes to an end, it proceeds to step S17, where it is decided whether the processed data part is the data part of the final block. In the present case, since it is not data part D15 of the final block, it returns to step S12.

In step S12, the data written in the header of the next block, header H12 in the present case, is read. Since in header H12 it is written that the data of data part D12 is data that is not to be stored in memory unit 53, in step [S]12 it is decided that the data of data part D12 is not data that is to be stored in memory unit 53, and it proceeds to step S18.

In step S18, arithmetic processing unit 51 transfers the data of data part D12 to expansion unit 52 and causes expansion processing to be performed on it. The expansion-processed expanded data d12 is returned to arithmetic processing unit 51. And in step S19, arithmetic processing unit 51 decides whether to store the returned data in DRAM 5. If it is decided to store it in DRAM 5, it proceeds to step S20, and expanded data d11 is stored in post-expansion data unit 5*b* of DRAM 5. Then, when the storage processing is completed, in step S17 arithmetic processing unit 51 decides whether the processed data is the final block. In the present case, since data part D12 was processed, it is decided that it is not the final block, it returns to step S12, and the processing beginning here is repeated on data part 12 and thereafter.

If in step S19 it is decided that it is not data that is to be stored in DRAM 5, in other words, that later-stage processing is not required and that it is data to be played by speaker 50, it proceeds to step S16. The processing beginning in step S16 has already been described, so its description is omitted.

By performing the above processing on data parts D11 through D15, the tone of one effect sound is generated and is played by speaker 50. In this way, the data stored in memory unit 53 is taken as tone data for the beginning part of one effect sound, and if there is a request to play this effect sound, the stored data can immediately be played by speaker 50. By processing and generating tones from the rest of the tone data while this stored data is being played, the delay from when a request is made to play a specified one effect sound until it is played can be kept short enough so that it is not noticed by the user.

For example, if this tone generation device is used for generating the effect sounds of a game machine, it is possible to vary the quantity of data to be stored in memory unit 53 according to the type of the data (the type of effect sound) so that the quantity of data (number of blocks) to be stored in memory unit 53 is made into two blocks of data for a frequently used effect sound and into one block of data for an infrequently used effect sound. It is also possible to write in the header of data that normally is used only once or a few times, such as the explanation of the story used in the opening of the game, data saying that not even one block is to be stored.

Figure 10:
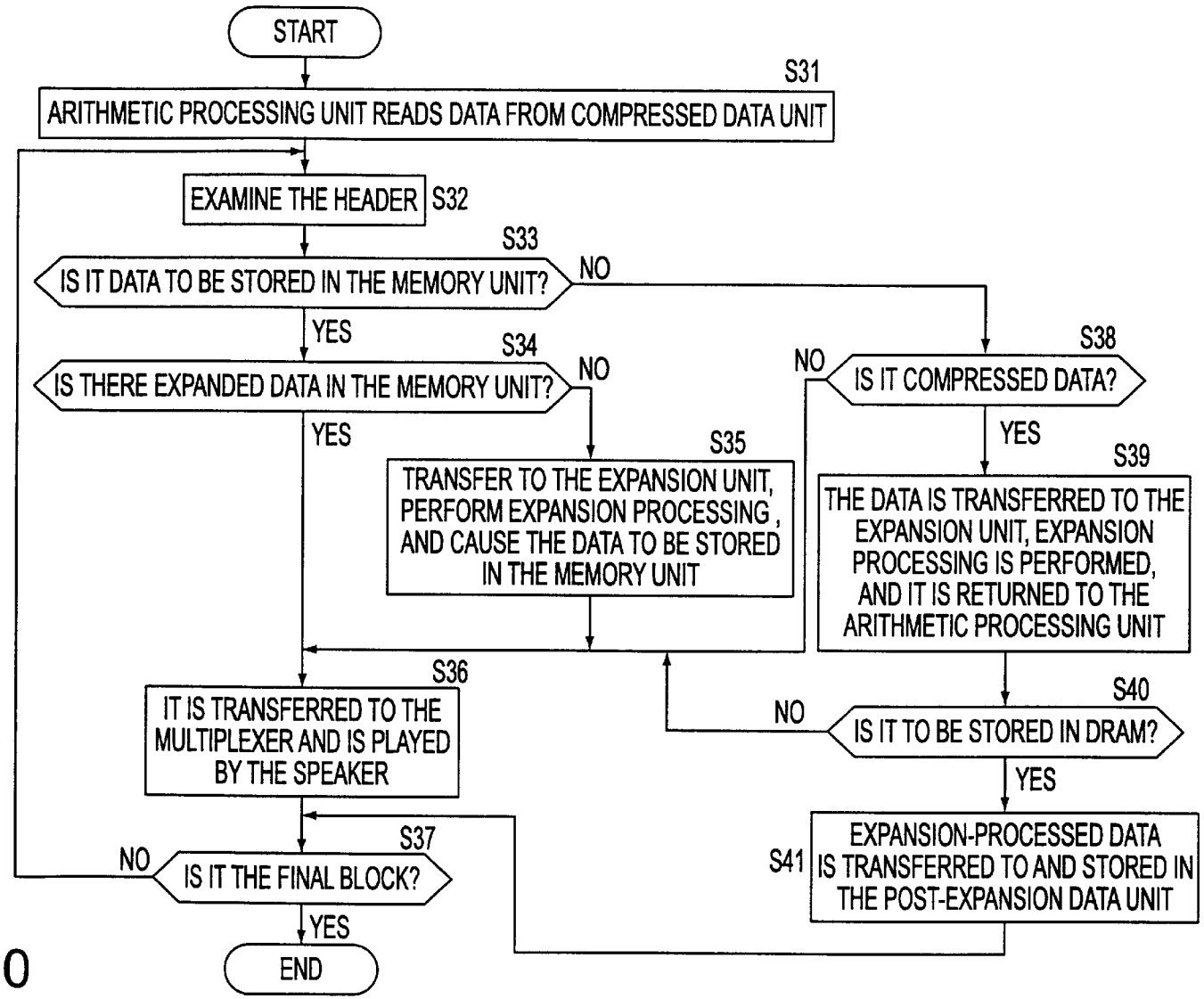
FIG. 10 is a flowchart explaining other expansion processing.

Next we describe, with reference to the flowchart in FIG. 10, the expansion operation of the tone generation device shown in FIG. 7 in a case where it handles data in which data having the data structure shown in FIG. 5 and data having the data structure shown in FIG. 8 are mixed together. In this case, for example, the data structure shown in FIG. 5 is used for the tone data of effect sounds used only once or a few times, such as in the opening narration of the game, while the data structure shown in FIG. 8 is used for the tone data of effect sounds that are used again and again. By thus adopting data structures that fit the tone data, tone generation can be done in which the delay is shortened.

The processing of steps S31 through S37 is processing for the case in which data is read that has the data structure shown in FIG. 8; an explanation of the processing in these steps is omitted, because it is the same processing as the processing in steps S11 through S17 in FIG. 9.

If in step S33 it is decided that the data read from compressed data unit 5*a* is not data that is to be stored in memory unit 53, it proceeds to step S38. In step S38, arithmetic processing unit 51 decides whether the read data is compressed data. This decision is made using the data written in the header of each block. If it is decided that the read data is not compressed data, that is, in this case, if it is decided that it is uncompressed data, it proceeds to step S36, and this data is transferred to multiplexer 9 and is further transferred to speaker 50 and is played.

If in step S38 it is decided that the read data is compressed data, it proceeds to step S40. Arithmetic processing unit 51 transfers the read data to expansion unit 52 and causes expansion processing to be performed on it. Then the expanded data is again returned to arithmetic processing unit 51.

In step S40 it is decided whether the data returned to arithmetic processing unit [51] is to be stored in DRAM 5. The flow of processing beginning with this step S40 is the same flow as the flow of processing beginning with step S19 in FIG. 9, so a description of it is omitted.

In the embodiment described above, when arithmetic processing unit 51 reads data from compressed data unit 5*a* (step S1 in FIG. 6, step S11 in FIG. 9, step S31 in FIG. 10), the data of an entire one effect sound (the header plus the data part) is read, but it also suffices to read only the header and to perform the subsequent processing. Also, one may read it for each block.

Because uncompressed data or data stored in memory unit 53 requires no later-stage processing, it was considered as data which is never stored in post-expansion data unit 5*b*, but it may be stored. Even if it is arranged that the data is stored in post-expansion data unit 5*b*, no time is needed for the expansion processing of such data, so this invention is effective as a means for shortening the delay time from when a request is made for playing a prescribed tone until it is played.

The distribution means for supplying the user with a computer program that executes the above processing includes, besides information recording media such as magnetic disk and CD-ROM, transmission media by networks, such as Internet or digital satellite.

With the above described tone generation device, the tone generation method, the distribution medium, and the data recording medium, tone data is read that consists of first data that is either not compressed or is compressed by a first compression method that requires a short time for expansion processing, and second data that is compressed by a second compression method that requires a longer time for expansion processing than the first compression method does. Among the read data, the first data is expanded as necessary and output and the second data is expanded and output. This shortens the delay time from when a request is made for playing a prescribed tone until it is played and makes it possible to use a high-efficiency encoding audio compression method for the tone data compression.

With the tone generation device of the present invention, the tone generation method, and the distribution medium, tone data read from a memory unit in which compressed tone data is stored is expanded, it is decided whether to store the expanded tone data. Depending on the result of this decision, the expanded tone data is stored, and the stored data or expanded data is selected and output, thus shortening the delay time from when a request is made for playing a prescribed tone until it is played and making it possible to use a high-efficiency encoding audio compression method for the tone data compression.

What is claimed is:

1. A tone generation device comprising:

a reading means that reads tone data consisting of a first data that either is not compressed or is compressed by a first compression method whose time required for expansion processing is short, and second data that is compressed by a second compression method whose time required for expansion processing is longer than for said first compression method, each of said first and second data having a header part and data part, a first output means that expands said first data as necessary among the data read by said reading means and outputs it, and second output means that expands and outputs said second data.

2. A tone generation method comprising:

a reading step that reads tone data consisting of first data that either is not compressed or is compressed by a first compression method whose time required for expansion processing is short, and second data that is compressed by a second compression method whose time required for expansion processing is longer than for said first compression method, each of said first and second data having a header part and data part, a first output step that expands said first data as necessary among the data read by said reading means and outputs it, and a second output step that expands and outputs said second data.

3. A distribution medium comprising a computer-readable program that executes a method of processing comprising the steps of:

reading tone data consisting of first data that either is not compressed or is compressed by a first compression method whose time required for expansion processing is short, and second data that is compressed by a second compression method whose time required for expansion processing is longer than for said first compression method, each of said first and second data having a header part and data part, expanding as necessary said first data among the data read by said reading means and outputs it, and expanding said second data and outputting said second data.

4. A data recording medium for recording tone data comprising first data that either is not compressed or is compressed by a first compression method whose time required for expansion processing is short, and second data that is compressed by a second compression method whose time required for expansion processing is longer than for said first compression method, each of said first and second data having a header part and data part, wherein when a computer reads out said data from the data recording medium, said first data that is not compressed is immediately played, said first data that is compressed by a first compression method whose time required for expansion processing is short is expanded and played in a short time, and then said second data is expanded and played.

5. A tone generation device comprising:

an arithmetic processing unit for reading data in a header part of tone data that has the header part and a data part and for deciding whether the data in the data part has been compressed, first memory means for storing compressed tone data, expansion means that expands said compressed tone data read by said first memory means, decision means that decides whether to store the tone data expanded by said expansion means, second memory means for storing the tone data expanded by said expansion means in accordance with the decision result of said decision means, and output means that selects and outputs the output obtained with said second memory means or the output obtained with said expansion means.

6. A tone generation method comprising:

a decision step for using an arithmetic processing unit to read data in a header part of tone data that has the header part and a data part and for deciding whether the data in the data part has been compressed, a first memory step for storing compressed tone data, an expansion step that expands said compressed tone data read in said first memory step, a decision step that decides whether to store said tone data expanded in said expansion step, a second memory step for storing the tone data expanded in said expansion step in accordance with the decision result of said decision step, and an output step that selects and outputs the output of said second memory step or the output of said expansion step.

7. A distribution medium comprising a computer-readable program that executes a method of processing comprising the steps of:

a) reading data in a header part of tone data that has the header part and a data part and for deciding whether the data in the data part has been compressed, b) storing compressed tone data, c) expanding said compressed tone data read in step b, d) deciding whether to store said tone data expanded in step c), e) storing the tone data expanded in step c) in accordance with the decision result of step d), and f) selecting and outputting the output obtained in step e) or the output obtained in step c).

* * * * *